US005902028A

United States Patent [19]

Hsu et al.

[11] Patent Number: 5,902,028

[45] Date of Patent: May 11, 1999

[54] FIRE EXTINGUISHER BOX

[76] Inventors: Wen-Chien Hsu, No. 20, Hsi Tsuo Rd., DinJung Village, Ta-Chen Hsiang Hua-Lien; Tin-Huang Hsiao, No. 102, Hsia-Men St., Lin Ya Dist., Kaohsiung, both of Taiwan

[21] Appl. No.: 09/026,112

[22] Filed: Feb. 19, 1998

[51] Int. Cl.[6] ..... A62C 13/78; A47B 81/00

[52] U.S. Cl. ..... 312/271; 312/248; 312/275; 312/325; 169/51

[58] Field of Search ..... 312/246, 245, 312/248, 271, 273, 274, 275, 276, 242, 127, 129, 130, 293.2, 325, 326, 327, 328, 329; 169/51

[56] References Cited

U.S. PATENT DOCUMENTS

| | | | |
|---|---|---|---|
| 1,349,232 | 8/1920 | Stanko | 312/275 X |
| 2,555,644 | 6/1951 | Heer | 312/317.1 |
| 2,902,327 | 9/1959 | Larsen | 312/276 X |
| 4,647,118 | 3/1987 | Kamperman | 312/276 X |
| 5,474,374 | 12/1995 | Sandvig | 312/271 X |

FOREIGN PATENT DOCUMENTS

| | | | |
|---|---|---|---|
| 2524407 | 12/1976 | Germany | 312/325 |
| 7412394 | 6/1975 | Netherlands | 312/325 |

*Primary Examiner*—Jose V. Chen
*Assistant Examiner*—Janet M. Wilkens
*Attorney, Agent, or Firm*—W. Wayne Liauh

[57] ABSTRACT

A fire extinguisher box is composed of a box body in which a base frame and a link mechanism are mounted. The base frame is fastened pivotally with a seat for locating the fire extinguisher in the box body. The link mechanism is composed of an upright rod fastened with the base frame, a first link rod fastened with the upright rod, and a second link rod coupled with the first link rod and a pull rod of a door of the box body. As the door of the box body is opened, the link mechanism is actuated by the pull rod such that the base frame is driven by the link mechanism to locate at an inclined position, thereby causing the fire extinguisher to locate likewise so as to enable a person to remove the fire extinguisher from the box body easily and quickly.

7 Claims, 9 Drawing Sheets

FIRE EXTINGUISHER BOX

FIELD OF THE INVENTION

The present invention relates generally to a fire extinguisher accessory, and more particularly to a fire extinguisher box.

BACKGROUND OF THE INVENTION

The fire extinguishers are ubiquitously located in schools, hospitals, public service or office buildings, apartment buildings, airports, bus or train terminals, public transportation vehicles, ships, etc. The fire extinguishers are generally located such that they are accessible for an emergency use. In order to protect the fire extinguishers from corrosion or being tampered with by the innocent children, the fire extinguishers are often kept in a box. Moreover, the fire extinguishers are generally kept still in a rack or box on the vehicles or ships.

As shown in FIG. 1, a fire extinguisher box 1 of the prior art is provided therein with an L-shaped seat 11 fastened therewith. The seat 11 is provided with a first fastening strap 12 secured to one side of the seat 11, and a second fastening strap 15 secured to another side of the seat 11 by means of a connection piece 14 and a fastening bolt 13. The second fastening strap 15 is fastened with a grip 16. As illustrated in FIG. 2, a fire extinguisher 2 is securely located in the fire extinguisher box 1 of the prior art such that the fire extinguisher 2 is securely embraced by the straps 12 and 15, which are engaged with each other in such a manner that the free end of the first fastening strap 12 is located in a locating hole 151, and that the grip 16 is pressed by the fastening strap 12 to cause one side of the grip 16 to press against a curved portion 121 of the first fastening strap 12, and further that the engagement of the fastening straps 12 and 15 is further secured by a fastening pin 17 which is inserted into a pin hole 122 located at the free end of the first fastening strap 12.

Such a prior art fire extinguisher box 1 as described above is defective in design in that the fire extinguisher 2 can not be removed from the box 1 quickly. In the process of removing the fire extinguisher 2 from the box 1, the fastening pin 17 must be first removed from the pin hole 122 so as to release the grip 16, thereby enabling the free end of the first strap 12 to disengage the locating hole 151 of the second fastening strap 15. It is therefore conceivable that the fire extinguisher 2 is in fact inaccessible to a person who is not familiar with the process of removing the fire extinguisher 2 from the fire extinguisher box 1.

SUMMARY OF THE INVENTION

The primary objective of the present invention is to provide a fire extinguisher box free from the drawbacks of the prior art fire extinguisher box described above.

The fire extinguisher box of the present invention consists of a rectangular box body in which a base frame and a link mechanism are mounted. The base frame is fastened pivotally with an L-shaped seat for securing a fire extinguisher and is driven by the link mechanism which is composed of a pull rod fastened pivotally with a door of the box body. As the door of the box body is opened, the link mechanism is actuated by the pull rod such that the base frame is driven by the link mechanism to recline, thereby causing the fire extinguisher to recline likewise so as to be removed easily and quickly from the box body. The L-shaped seat is provided with a retainer capable of holding securely the fire extinguisher.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
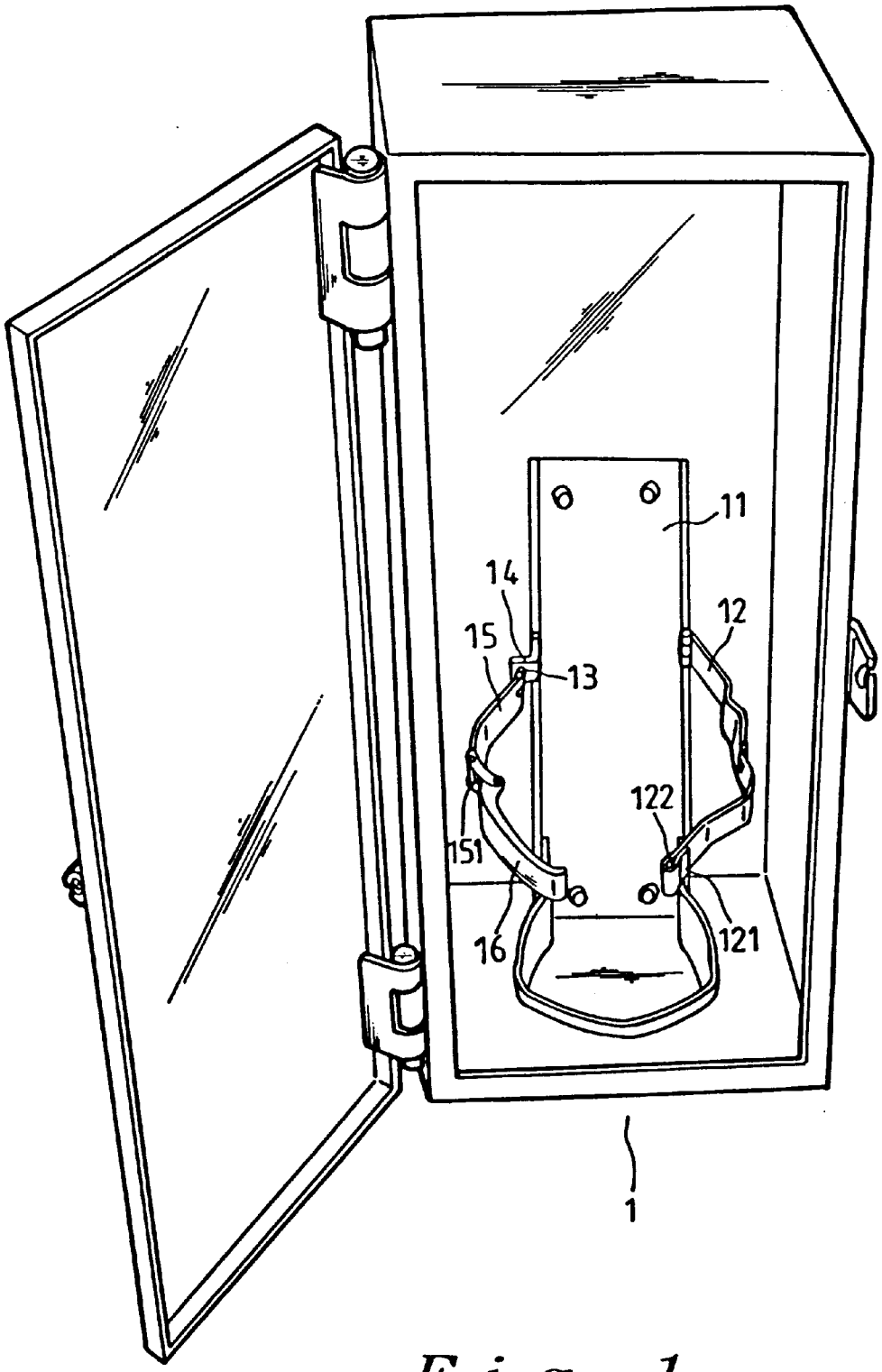
Fig. 1 PRIOR ART
FIG. 1 shows a perspective view of a fire extinguisher box of the prior art.
Figure 2:
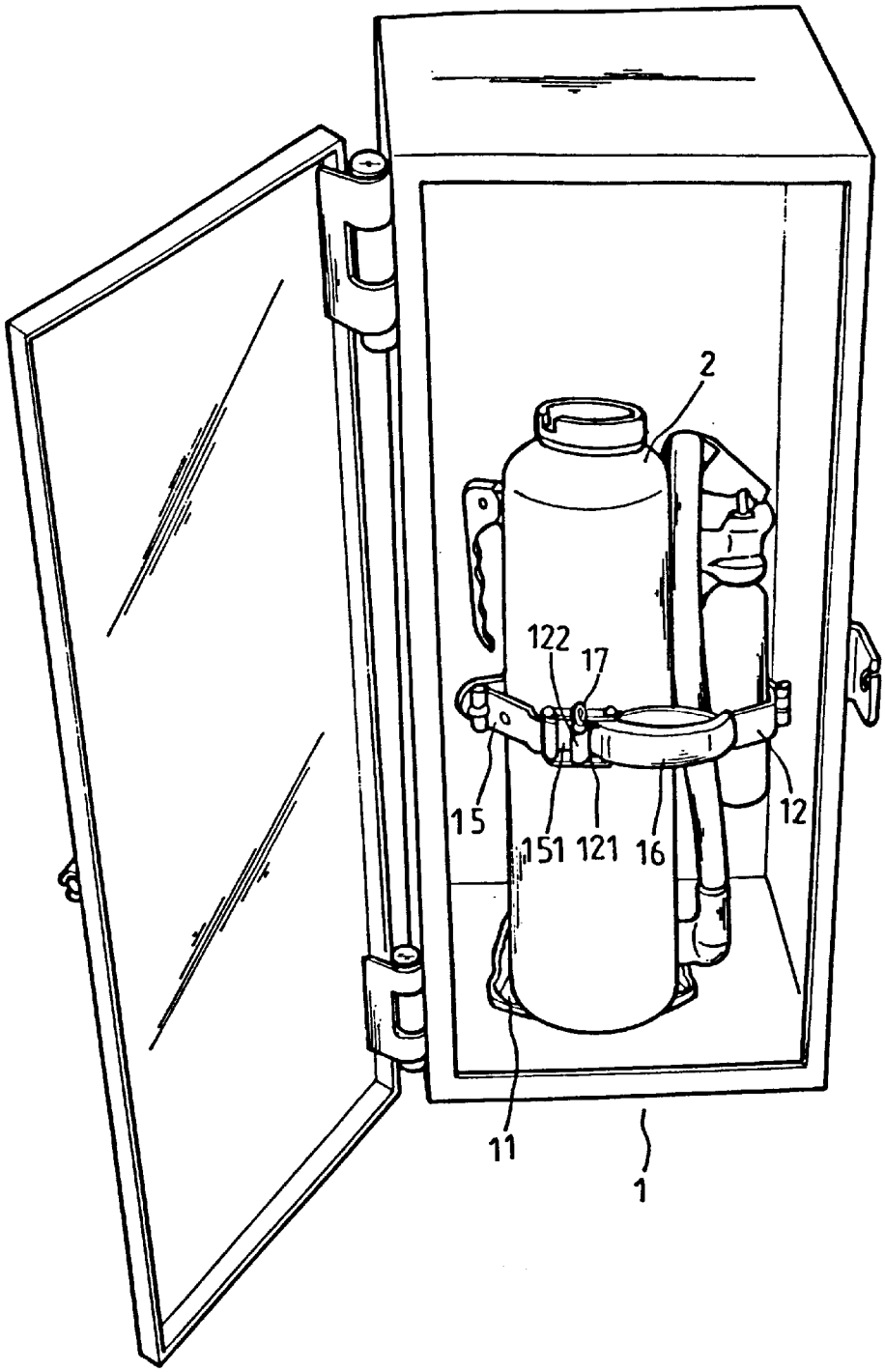
Fig · 2 PRIOR ART
FIG. 2 shows a schematic view of the prior art fire extinguisher box at work.
Figure 3:
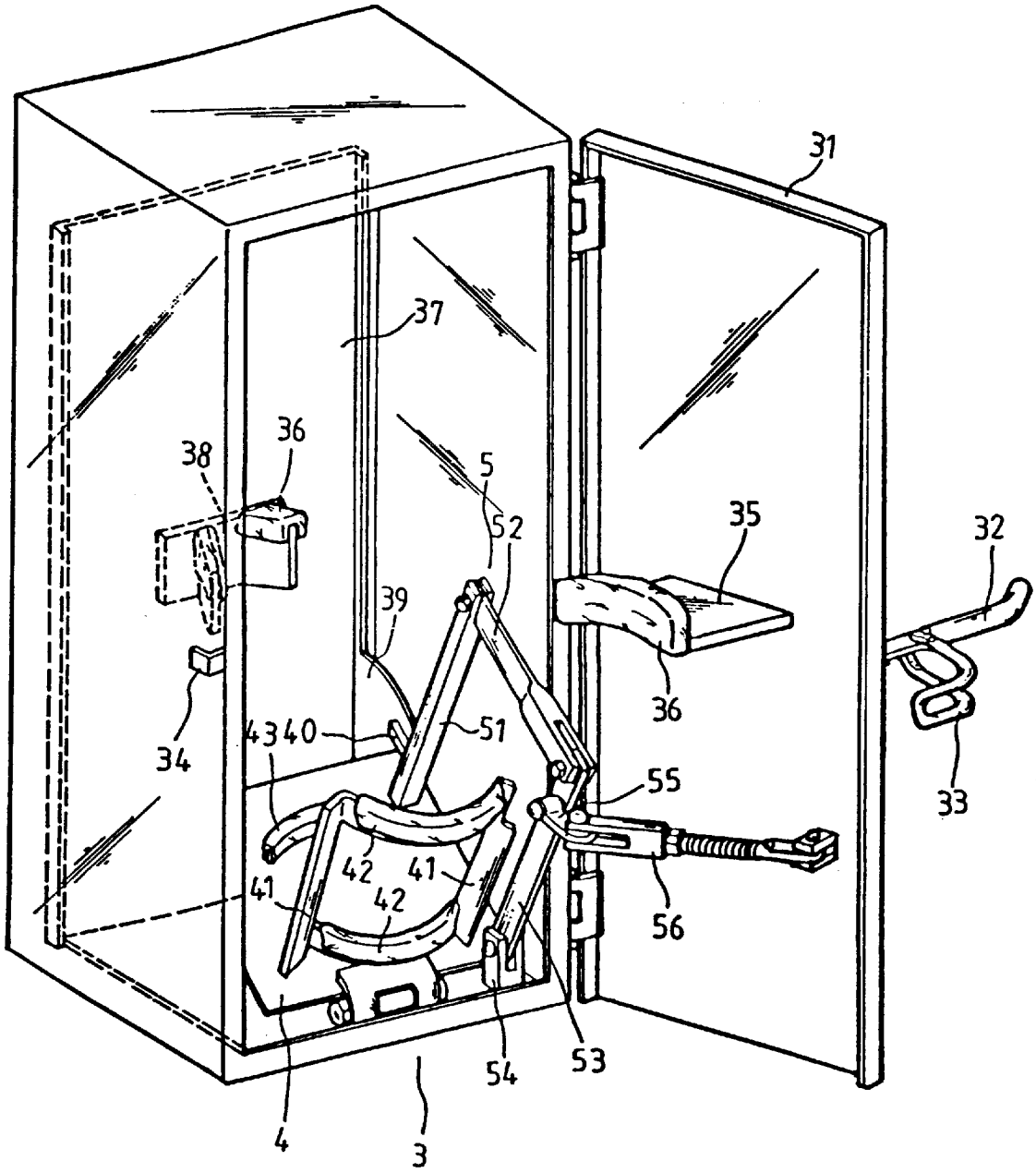
FIG. 3 shows a perspective view of a fire extinguisher of the present invention.

As shown in FIGS. 3–9, a fire extinguisher box embodied in the present invention is composed of a rectangular box body 3, a base frame 4, and a link mechanism 5.

The box body 3 comprises a door 31 having a handle 32 with a hook 33 engageable with a retaining piece 34 which is fastened with the edge of a side wall of the box body 3. The door 31 is provided in the inner side thereof with a locating body 35 fastened therewith. The locating body 35 has a pad 36. The box body 3 further comprises an L-shaped seat 37, which is provided with a retainer 38 corresponding in location to the locating body 35 of the door 31. The retainer 38 has a pad 36. The seat 37 is provided in one side thereof with an extension body 39 having a protuberance 40.

The base frame 4 is pivotally fastened with the seat 37 of the box body 3 and is provided with two connection rods 41, an arresting piece 42 connected with the connection rods 41, and an arresting rib 43 opposite to the arresting piece 42.

The link mechanism 5 is composed of an upright rod 51, a first link rod 52 connected with the top end of the upright rod 51, and a second link rod 53 connected with the first link rod 52 such that one end of the second link rod 53 is pivotally fastened with a pivoting piece 54 which is fastened with the box body 3. The second link rod 53 is provided with a swing piece 55 fastened pivotally therewith such that the swing piece 55 is fastened pivotally at the free end thereof with one end of a pull rod 56 which is in turn fastened pivotally at another end thereof with the inner side of the door 31. The upright rod 51 is fastened at one end thereof with the base frame 4.

Figure 4:
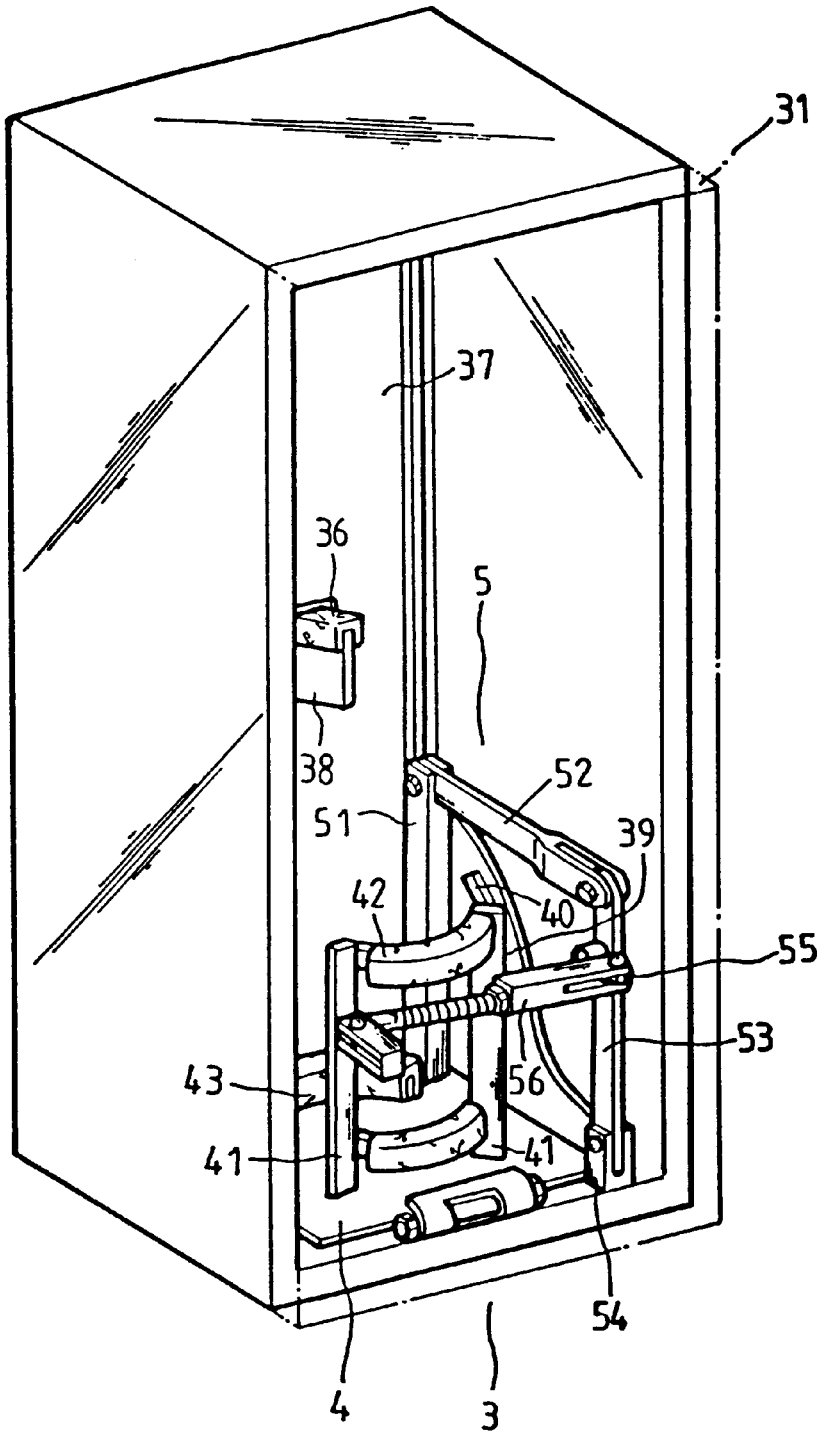
FIG. 4 shows a schematic view of the present invention at work.
Figure 5:
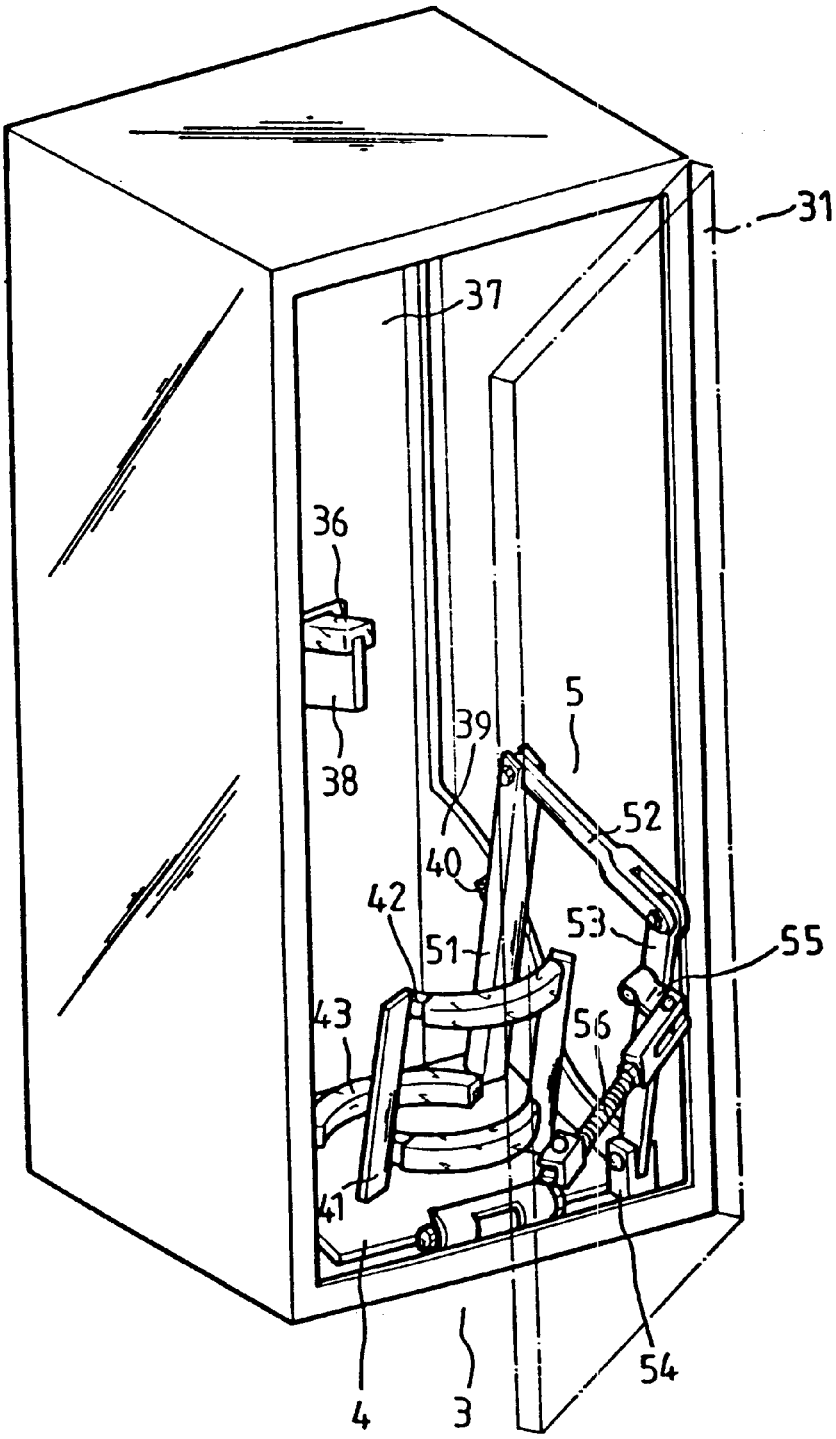
FIG. 5 shows another schematic view of the present invention at work.
Figure 6:
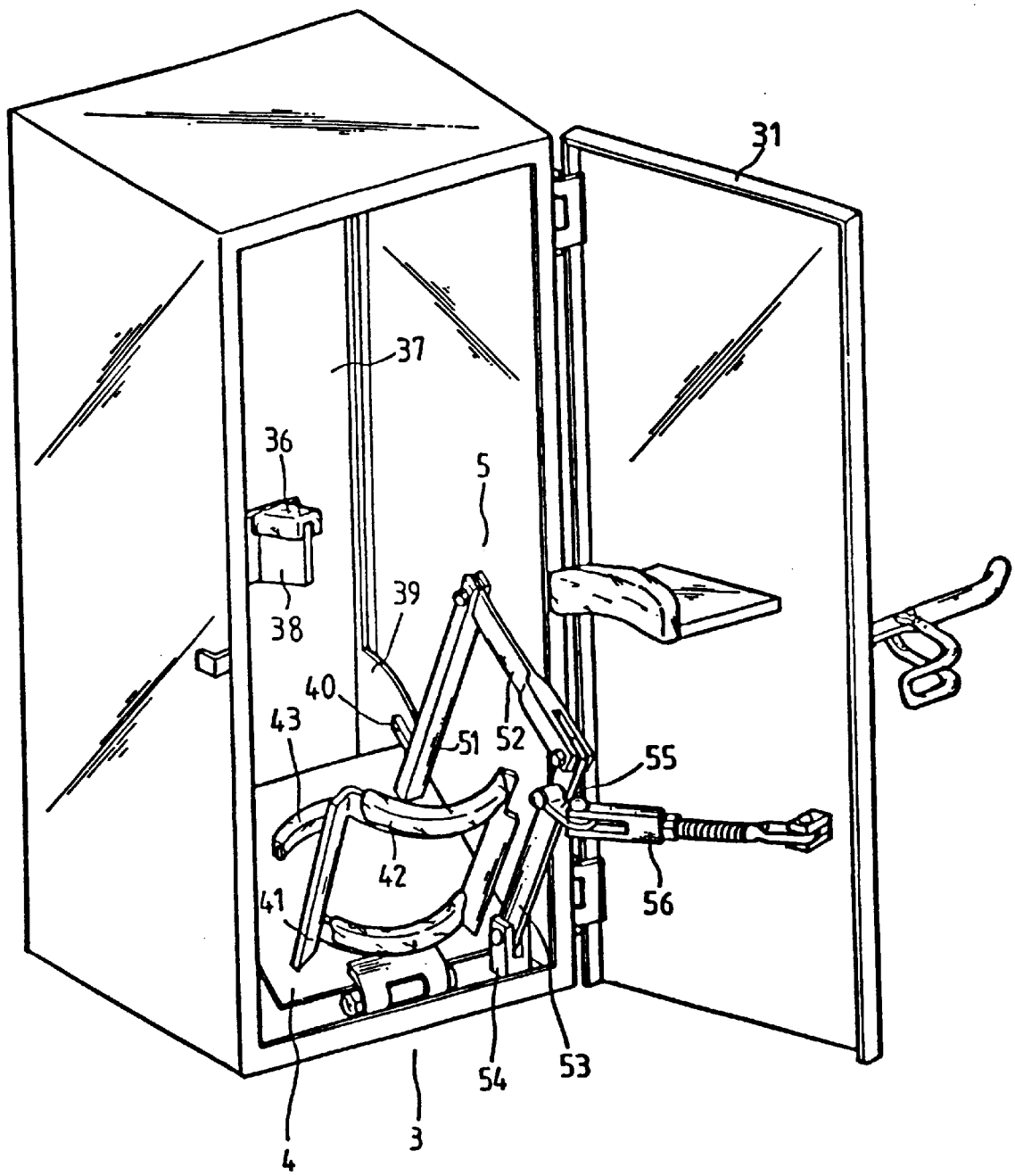
FIG. 6 shows still another schematic view of the present invention at work.

As illustrated in FIGS. 4 and 5, when the door 31 is opened, the swing piece 55 of the link mechanism 5 is actuated by the pull rod 56 such that the second link rod 53 is caused to incline on the pivoting piece 54, and that the first link rod 52 is thus actuated by the second link rod 53, and further that the upright rod 51 is actuated by the first link rod 52. As a result, the base frame 4 is caused to swivel until such time when the base frame 4 is stopped by the protuberance 40 of the extension body 39 of the seat 37, thereby causing the base frame 4 to be located at an inclined position, as shown in FIG. 6.

Figure 7:
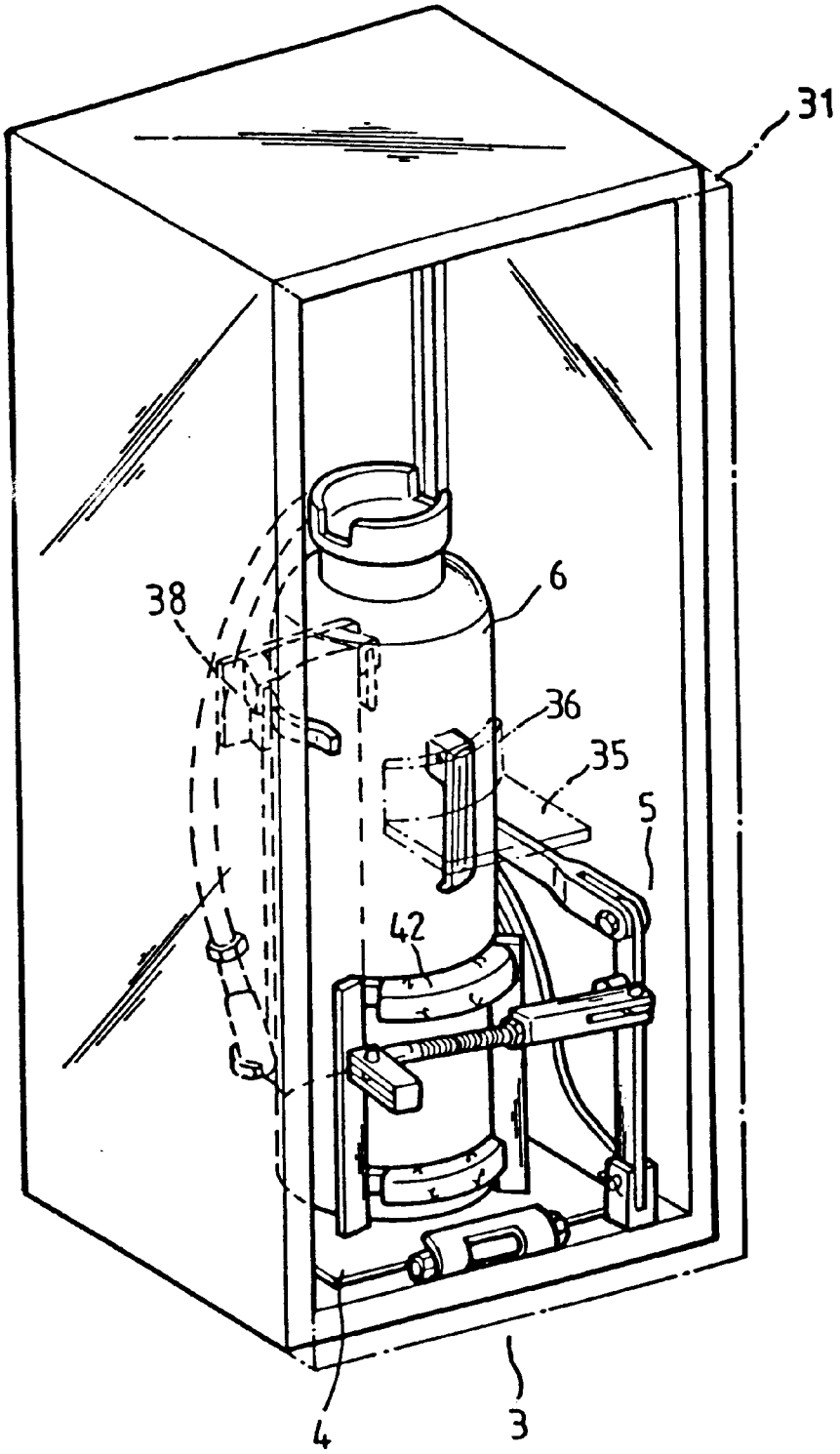
FIG. 7 shows still another schematic view of the present invention at work.

As shown in FIG. 7, a fire extinguisher 6 is mounted on the base frame 4 such that the fire extinguisher 6 is located by the arresting piece 42 and the arresting rib 43 of the base frame 4. Moreover, when the door 31 is closed, the fire extinguisher 6 is further located by the locating body 35 of the door 31 and the retainer 38 of the seat 37 of the box body 3.

Figure 8:
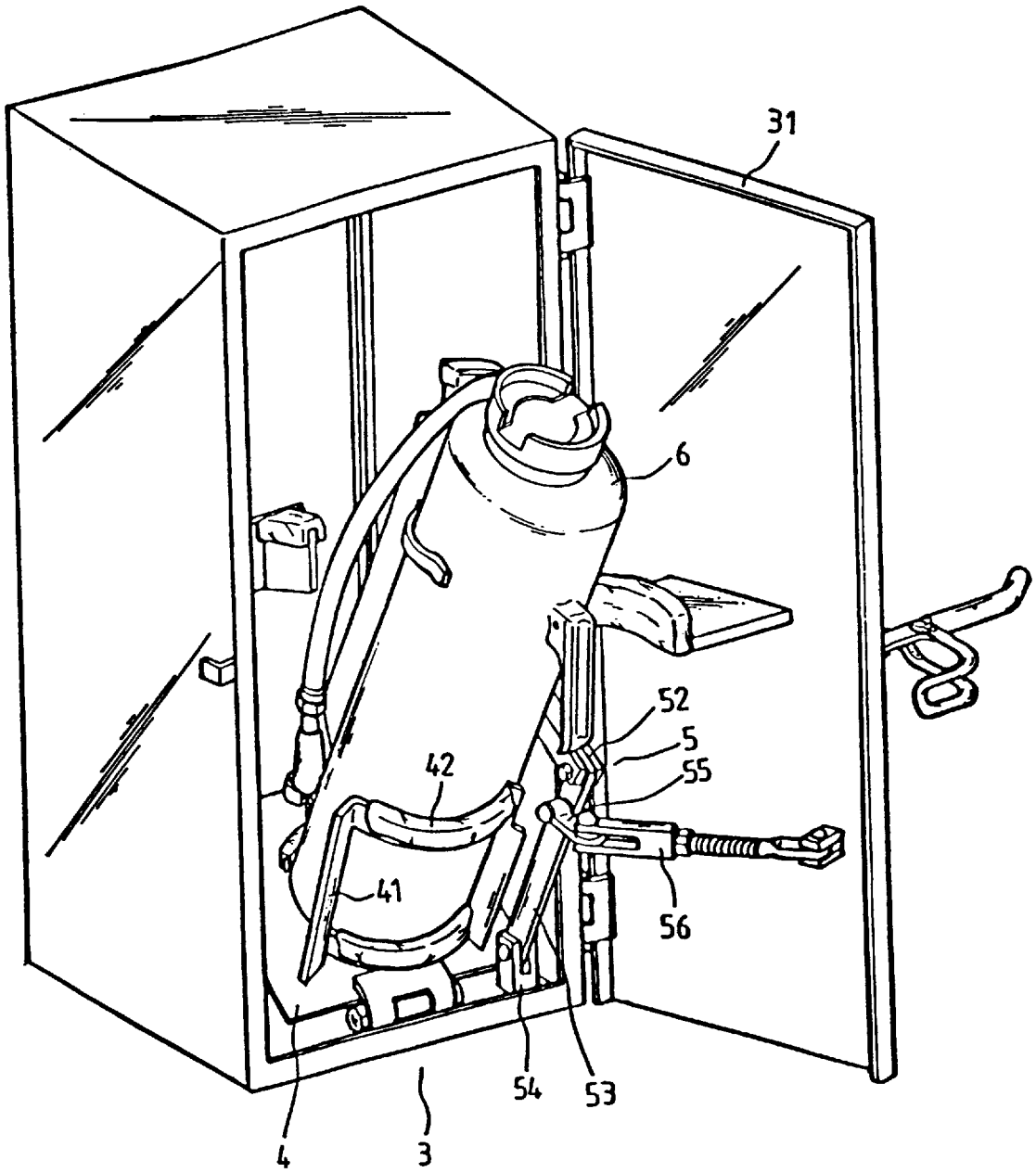
FIG. 8 shows still another schematic view of the present invention at work.

As illustrated in FIG. 8, when the door 31 is opened, the link mechanism 5 is immediately triggered by the pull rod 56 such that the base frame 4 is actuated by the link mechanism 5 to locate at an inclined position, and that the arresting piece 42 of the base frame 4 serves to support the fire extinguisher 6 which is located at an inclined position, The fire extinguisher 6 is thus readily accessible as soon as the door 31 is opened.

Figure 9:
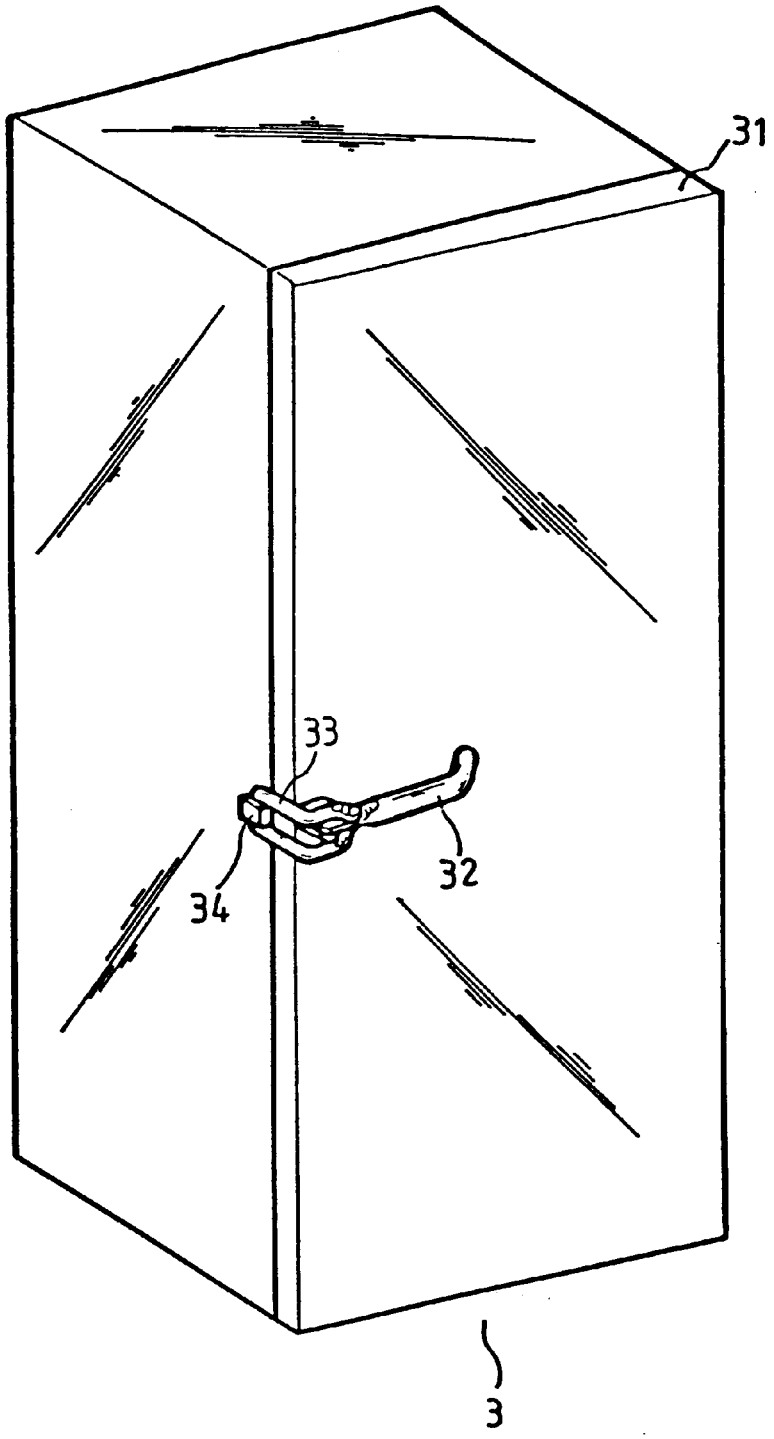
FIG. 9 shows a perspective view of the present invention.

As shown in FIG. 9, the hook 33 of the handle 32 of the door 31 is securely engaged with the retaining piece 34 of the box body 3 so as to ensure that the door 31 remains closed securely.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A fire extinguisher box comprising:

a box body provided with a door fastened pivotally therewith such that said door can be closed or opened, said door provided in an outer side thereof with a handle fastened therewith and in an inner side thereof with a pull rod fastened pivotally therewith;

a base frame fastened pivotally in said box body and composed of two connection rods and an arresting piece connected with said connection rods; and a link mechanism composed of an upright rod fastened at one end thereof with said base frame, a first link rod fastened at one end thereof with another end of said upright rod, a second link rod fastened at one end thereof with another end of said first link rod such that said second link rod is fastened pivotally at another end thereof with a pivoting piece fastened with said box body, and a swing piece fastened pivotally at one end thereof with said second link rod and at another end thereof with said pull rod of said door.

2. The fire extinguisher box as defined in claim 1, wherein said box body is provided with a retainer fastened therewith; and wherein said handle of said door is provided with a hook engageable with said retainer of said box body at such time when said door is joined with said box body.

3. The fire extinguisher box as defined in claim 1, wherein said box body is provided therein with an L-shaped seat fastened therewith; and wherein said base frame is mounted pivotally on said seat such that said base frame can be caused to locate at an inclined position at such time when said door is opened, and that a fire extinguisher held by said base frame is caused to incline likewise.

4. The fire extinguisher box as defined in claim 3, wherein said seat is provided in one side thereof with an extension body having a protuberance capable of locating said base frame at the inclined position.

5. The fire extinguisher box as defined in claim 1, wherein said door is provided in said inner side thereof with a locating body fastened therewith; and wherein said box body is provided therein with a retainer corresponding in location to said locating body of said door.

6. The fire extinguisher box as defined in claim 5, wherein said locating body and said retainer are provided respectively with a pad fastened therewith.

7. The fire extinguisher box as defined in claim 1, wherein said base frame is further composed of an arresting rib opposite in location to said arresting piece and capable of locating a fire extinguisher disposed on said base frame.

* * * * *